US007488395B2

(12) United States Patent
Nakamura et al.

(10) Patent No.: US 7,488,395 B2
(45) **Date of Patent: *Feb. 10, 2009**

(54) FUNCTIONALLY GRADED RARE EARTH PERMANENT MAGNET

(75) Inventors: Hajime Nakamura, Echizen (JP); Koichi Hirota, Echizen (JP); Masanobu Shimao, Echizen (JP); Takehisa Minowa, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/340,521

(22) Filed: Jan. 27, 2006

(65) Prior Publication Data

US 2006/0213585 A1 Sep. 28, 2006

(30) Foreign Application Priority Data

Mar. 23, 2005 (JP) ..... 2005-084358

(51) Int. Cl.
*H01F 1/057* (2006.01)
*H01F 1/058* (2006.01)

(52) U.S. Cl. ..... 148/302; 148/301; 75/232; 75/236; 75/244

(58) Field of Classification Search ..... None
See application file for complete search history.

(56) References Cited

U.S. PATENT DOCUMENTS 5,194,099 A * 3/1993 Esper et al. ..... 148/302
5,411,603 A * 5/1995 Vial et al. ..... 148/101

(Continued)

FOREIGN PATENT DOCUMENTS

EP 1 830 371 A1 9/2007

(Continued)

OTHER PUBLICATIONS

Machine Transaltionof Japanese Patent Document 06-244011.*

(Continued)

*Primary Examiner*—John P Sheehan
(74) *Attorney, Agent, or Firm*—Westerman, Hattori, Daniels & Adrian, LLP.

(57) ABSTRACT

A functionally graded rare earth permanent magnet having a reduced eddy current loss in the form of a sintered magnet body having a composition $R_aE_bT_cA_dF_eO_fM_g$ is obtained by causing E and fluorine atoms to be absorbed in a R—Fe—B sintered magnet body from its surface. F is distributed such that its concentration increases on the average from the center toward the surface of the magnet body, the concentration of E/(R+E) contained in grain boundaries surrounding primary phase grains of $(R,E)_2T_{14}A$ tetragonal system is on the average higher than the concentration of E/(R+E) contained in the primary phase grains, the oxyfluoride of (R,E) is present at grain boundaries in a grain boundary region that extends from the magnet body surface to a depth of at least 20 μm, particles of the oxyfluoride having an equivalent circle diameter of at least 1 μm are distributed in the grain boundary region at a population of at least 2,000 particles/mm$^2$, the oxyfluoride is present in an area fraction of at least 1%. The magnet body includes a surface layer having a higher electric resistance than in the interior. In the permanent magnet, the generation of eddy current within a magnetic circuit is restrained.

8 Claims, 2 Drawing Sheets

U.S. PATENT DOCUMENTS

| | | | | | |
|---|---|---|---|---|---|
| 5,766,372 | A * | 6/1998 | Fujimura et al. | ..... | 148/101 |
| 5,858,124 | A * | 1/1999 | Endo et al. | ..... | 148/302 |
| 6,296,720 | B1 * | 10/2001 | Yamamoto et al. | ..... | 148/302 |
| 6,302,939 | B1 * | 10/2001 | Rabin et al. | ..... | 75/338 |
| 6,960,240 | B2 * | 11/2005 | Hirota et al. | ..... | 75/610 |
| 7,053,745 | B2 * | 5/2006 | Yoshimura et al. | ..... | 335/302 |
| 2004/0187970 | A1 * | 9/2004 | Ishizaka et al. | ..... | 148/302 |

FOREIGN PATENT DOCUMENTS

| | | | |
|---|---|---|---|
| JP | 61-195954 | * | 8/1986 |
| JP | 1-251704 | * | 10/1989 |
| JP | 3-188241 | * | 8/1991 |
| JP | 4-184901 | * | 7/1992 |
| JP | 4-328804 | | 11/1992 |
| JP | 5-31807 | | 5/1993 |
| JP | 6-244011 A1 | | 9/1994 |
| JP | 3143156 | | 3/2001 |
| JP | 3471876 | | 9/2003 |
| JP | 2003-282312 | | 10/2003 |
| JP | 2004-304038 | | 10/2004 |
| JP | 2005-11973 | | 1/2005 |
| WO | 2004/114333 A1 | | 12/2004 |
| WO | WO 2005/123974 A1 | * | 12/2005 |

OTHER PUBLICATIONS

The Journal of the Institute of Electrical Engineers of Japan, vol. 124, 2004, pp. 699-702, published on Nov. 1, 2004.

Press Release (Shin-Etsu News) dated on Mar. 24, 2005.

Intermag Asia 2005; Digest of the IEEE International Magnetics Conference; p. 476; held on Apr. 4-8, 2005.

Techno-Frontier Symposium 2005; pp. B1-2-1 to B1-2-12; held on Apr. 20, 2005 by JMA.

IEEE Transactions on Magnetics, vol. 41, No. 10. Oct. 2005, pp. 3844-3846.

Hwang D. H. et al. "Development of High Coercive Powder From the Nd-Fe-B Sintered Magnet Scrap", IEEE Transactions on Magnetics, IEEE Service Center, New York, NY, US, vol. 40, No. 4, Jul. 2004, pp. 2877-2879.

Extended European Search Report dated Jan. 14, 2008 of European Application No. 0625054.8.

Abstract of Autumn Meeting of Japan Society of Powder Metallurgy, 2005; p. 143; held on Nov. 14-16, 2005.

2005 BM Symposium, Abstract of Presentation by the Japan Association of Bonded Magnet Industries held on Dec. 2, 2005.

K. D. Durst et al.; "The Coercive Field of Sintered and Melt-Spun NdFeB Magnets", Journal of Magnetism and Magnetic Materials, 68 (1987), pp. 63-75. Cited in the spec.

K. T. Park et al.; "Effect of Metal-Coating and Consecutive Heat Treatment on Coercivity of Thin Nd-Fe-B Sintered Magnets" Proceedings of the Sixteenth International Workshop on Rare-Earth Magnets and Their Applications, Sendai, (2000) pp. 257-264. Cited in the spec.

International Search Report of PCT/JP2005/005134 dated Jul. 12, 2005. Associated with copending U.S. Appl. No. 10/572,753.

Translation of International Preliminary Report on Patentability mailed May 3, 2007 of International Application No. PCT/JP2005/005134. Associated with copending U.S. Appl. No. 10/572,753.

International Search Report, dated Jun. 28, 2005, International Application No. PCT/JP2005/005134. Associated with copending U.S. Appl. No. 10/572,753.

Copending U.S. Appl. No. 10/572,753 filed on Mar. 21, 2006.

* cited by examiner

FUNCTIONALLY GRADED RARE EARTH PERMANENT MAGNET

CROSS-REFERENCE TO RELATED APPLICATION

This non-provisional application claims priority under 35 U.S.C. §119(a) on Patent Application No. 2005-084358 filed in Japan on Mar. 23, 2005, the entire contents of which are hereby incorporated by reference.

FIELD OF THE INVENTION

This invention relates to high-performance rare earth permanent magnets having a graded function that only a surface layer has a high electric resistance, wherein the generation of eddy current within a magnetic circuit is restrained.

BACKGROUND ART

Because of excellent magnetic properties, Nd—Fe—B permanent magnets find an ever increasing range of application. To meet the recent concern about the environmental problem, the range of utilization of magnets has spread to cover large-size equipment such as industrial equipment, electric automobiles and wind power generators. This requires further improvements in performance and electric resistance of Nd—Fe—B magnets.

Eddy current is one of factors that reduce the efficiency of motors. Although eddy current mainly generates in a magnetic core, the eddy current of the magnet itself becomes more noticeable as the motor becomes larger in size. Especially in the case of an interior permanent magnet (IPM) motor having a rotor wherein slots are perforated in a laminate of magnetic core plies stacked with interleaving insulating films and permanent magnets are in sliding fit with the slots, the magnets facilitate conduction between core plies, allowing a greater eddy current to generate. There have been proposed several methods for coating magnets with insulating resins. There are left some problems that resin coatings can be rubbed and stripped off when magnets are slidingly inserted into slots, and the "shrinkage fit" technique of securing magnets by utilizing thermal expansion is not applicable.

Also there have been proposed several methods of processing magnets into thin plates like the core plies, and stacking magnet plates with interleaving insulating plates. These methods are not widespread because of low productivity and increased costs.

Therefore, it is rather effective to increase the electric resistance of permanent magnets themselves, and a number of methods have been proposed. Since Nd—Fe—B permanent magnets are metallic materials, they have a low electric resistance, as demonstrated by a resistivity of $1.6\times10^{-6}$ Ω–m. In a typical prior art approach, a number of particles of high electric resistance substance such as rare earth oxide are dispersed in a magnet to induce more electron scattering by which the resistance of the magnet is increased. On the other hand, this approach reduces the volume fraction in the magnet of the primary phase of $Nd_2Fe_{14}B$ compound contributing to magnetism. There is a contradictory problem that the higher the resistance, the more outstanding become the magnetic property losses.

Japanese Patent No. 3,471,876 discloses a rare earth magnet having improved corrosion resistance, comprising at least one rare earth element R, which is obtained by effecting fluorinating treatment in a fluoride gas atmosphere or an atmosphere containing a fluoride gas, to form an $RF_3$ compound or an $RO_xF_y$ compound (wherein x and y have values satisfying $0<x<1.5$ and $2x+y=3$) or a mixture thereof with R in the constituent phase in a surface layer of the magnet, and further effecting heat treatment at a temperature of 200 to 1,200° C.

JP-A 2003-282312 discloses an R—Fe—(B,C) sintered magnet (wherein R is a rare earth element, at least 50% of R being Nd and/or Pr) having improved magnetizability which is obtained by mixing an alloy powder for R—Fe—(B,C) sintered magnet with a rare earth fluoride powder so that the powder mixture contains 3 to 20% by weight of the rare earth fluoride (the rare earth being preferably Dy and/or Tb), subjecting the powder mixture to orientation in a magnetic field, compaction and sintering, whereby a primary phase is composed mainly of $Nd_2Fe_{14}B$ grains, and a particulate grain boundary phase is formed at grain boundaries of the primary phase or grain boundary triple points, said grain boundary phase containing the rare earth fluoride, the rare earth fluoride being contained in an amount of 3 to 20% by weight of the overall sintered magnet. Specifically, an R—Fe—(B,C) sintered magnet (wherein R is a rare earth element, at least 50% of R being Nd and/or Pr) is provided wherein the magnet comprises a primary phase composed mainly of $Nd_2Fe_{14}B$ grains and a grain boundary phase containing a rare earth fluoride, the primary phase contains Dy and/or Tb, and the primary phase includes a region where the concentration of Dy and/or Tb is lower than the average concentration of Dy and/or Tb in the overall primary phase.

These proposals, however, are still insufficient in improving surface electric resistance.

JP-A 2005-11973 discloses a rare earth-iron-boron base magnet which is obtained by holding a magnet in a vacuum tank, depositing an element M or an alloy containing an element M (M stands for one or more rare earth elements selected from Pr, Dy, Tb, and Ho) which has been vaporized or atomized by physical means on the entirety or part of the magnet surface in the vacuum tank, and effecting pack cementation so that the element M is diffused and penetrated from the surface into the interior of the magnet to at least a depth corresponding to the radius of crystal grains exposed at the outermost surface of the magnet, to form a grain boundary layer having element M enriched. The concentration of element M in the grain boundary layer is higher at a position nearer to the magnet surface. As a result, the magnet has the grain boundary layer in which element M is enriched by diffusion of element M from the magnet surface. A coercive force Hcj and the content of element M in the overall magnet have the relationship:

$$Hcj \geqq 1+0.2\times M$$

wherein Hcj is a coercive force in unit MA/m and M is the content (wt %) of element M in the overall magnet and $0.05 \leqq M \leqq 10$. This method, however, is extremely unproductive and impractical.

DISCLOSURE OF THE INVENTION

An object of the present invention is to provide rare earth permanent magnets having a graded function and satisfying both a high electric resistance and excellent magnetic properties.

Regarding R—Fe—B sintered magnets (wherein R is one or more elements selected from rare earth elements inclusive of Sc and Y), typically Nd—Fe—B sintered magnets, the inventors have found that when a magnet body is heated at a temperature not higher than a sintering temperature, with a space surrounding the magnet body surface being packed with a powder based on a fluoride of R, both R and fluorine which have been in the powder are efficiently absorbed in the magnet body so that oxyfluoride particles having a high electric resistance are distributed only in a surface layer of the magnet body at a high density, for thereby increasing the electric resistance of only the surface layer. As a result, the generation of eddy current is restrained while maintaining excellent magnetic properties.

Accordingly, the present invention provides a functionally graded rare earth permanent magnet having a reduced eddy current loss in the form of a sintered magnet body which is obtained by causing E and fluorine atoms to be absorbed in a R—Fe—B sintered magnet body from its surface and which has an alloy composition of formula (1) or (2):

$$R_aE_bT_cA_dF_eO_fM_g \quad (1)$$

$$(R\bullet E)_{a+b}T_cA_dF_eO_fM_g \quad (2)$$

wherein R is at least one element selected from rare earth elements inclusive of Sc and Y, and E is at least one element selected from alkaline earth metal elements and rare earth elements, R and E may contain the same element or elements, the sintered magnet body has the alloy composition of formula (1) when R and E do not contain the same element(s) and has the alloy composition of formula (2) when R and E contain the same element(s), T is one or both of iron and cobalt, A is one or both of boron and carbon, F is fluorine, O is oxygen, and M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, a through g indicative of atom percents of the corresponding elements in the alloy have values in the range: $10 \leqq a \leqq 15$ and $0.005 \leqq b \leqq 2$ in case of formula (1) or $10.005 \leqq a+b \leqq 17$ in case of formula (2), $3 \leqq d \leqq 15$, $0.01 \leqq e \leqq 4$, $0.04 \leqq f \leqq 4$, $0.01 \leqq g \leqq 11$, the balance being c, the magnet body having a center and a surface. Constituent element F is distributed such that its concentration increases on the average from the center toward the surface of the magnet body. Grain boundaries surround primary phase grains of $(R,E)_2T_{14}A$ tetragonal system within the sintered magnet body. The concentration of E/(R+E) contained in the grain boundaries is on the average higher than the concentration of E/(R+E) contained in the primary phase grains. The oxyfluoride of (R,E) is present at grain boundaries in a grain boundary region that extends from the magnet body surface to a depth of at least 20 μm. Particles of the oxyfluoride having an equivalent circle diameter of at least 1 μm are distributed in the grain boundary region at a population of at least 2,000 particles/mm$^2$. The oxyfluoride is present in an area fraction of at least 1%. The magnet body includes a surface layer having a higher electric resistance than in the magnet body interior. As a consequence, the magnet has a reduced eddy current loss.

In preferred embodiments, R comprises at least 10 atom % of Nd and/or Pr; T comprises at least 60 atom % of iron; and A comprises at least 80 atom % of boron.

In this way, functionally graded rare earth permanent magnets are provided wherein the generation of eddy current within a magnetic circuit is restrained.

DESCRIPTION OF THE PREFERRED EMBODIMENTS

Figure 1:
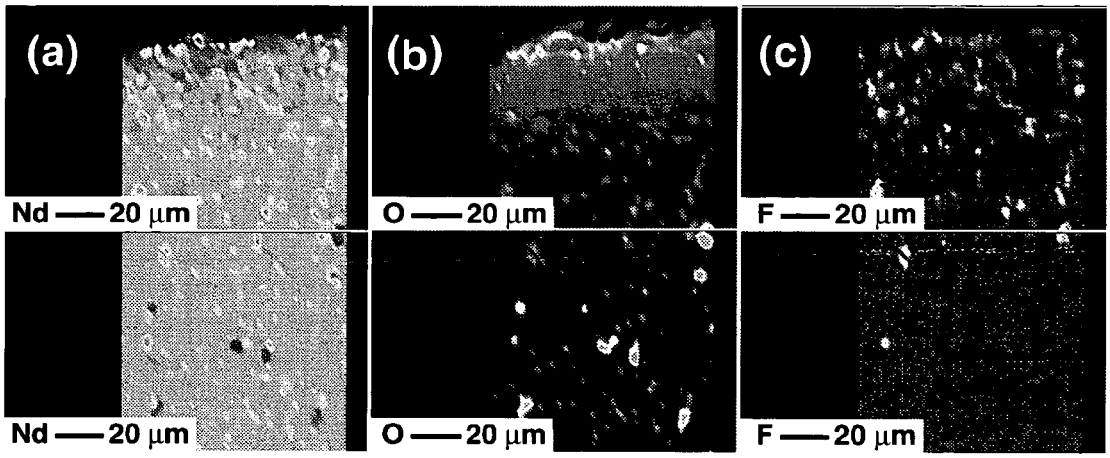
FIGS. 1*a*, 1*b*, and 1*c* are photomicrographs showing compositional distribution images of Nd, O, and F in a magnet body M1 manufactured in Example 1, respectively.

The rare earth permanent magnet of the invention is in the form of a sintered magnet body obtained by causing E and fluorine atoms to be absorbed in a R—Fe—B sintered magnet body. The resultant magnet body has an alloy composition of the formula (1) or (2).

$$R_aE_bT_cA_dF_eO_fM_g \quad (1)$$

$$(R\bullet E)_{a+b}T_cA_dF_eO_fM_g \quad (2)$$

Herein R is at least one element selected from rare earth elements inclusive of Sc and Y, and E is at least one element selected from alkaline earth metal elements and rare earth elements. R and E may be overlapped each other and may contain the same element or elements. When R and E do not contain the same element or elements each other, the sintered magnet body has the alloy composition of formula (1). When R and E contain the same element or elements each other, the sintered magnet body has the alloy composition of formula (2). T is one or both of iron (Fe) and cobalt (Co), A is one or both of boron and carbon, F is fluorine, O is oxygen, and M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W. The subscripts a through g indicative of atom percents of the corresponding elements in the alloy have values in the range: $10 \leqq a \leqq 15$ and $0.005 \leqq b \leqq 2$ in case of formula (1) or $10.005 \leqq a+b \leqq 17$ in case of formula (2), $3 \leqq d \leqq 15$, $0.01 \leqq e \leqq 4$, $0.04 \leqq f \leqq 4$, $0.01 \leqq g \leqq 11$, the balance being c.

Specifically, R is selected from among Sc, Y, La, Ce, Pr, Nd, Sm, Eu, Gd, Tb, Dy, Ho, Er, Yb, and Lu. Desirably, R contains Nd, Pr and Dy as a main component, the content of Nd and/or Pr being preferably at least 10 atom %, more preferably at least 50 atom % of R.

E is at least one element selected from alkaline earth metal elements and rare earth elements, for example, Mg, Ca, Sr, Ba, La, Ce, Pr, Nd, Sm, Eu, Gd, Tb, Dy, Ho, Er, Yb, and Lu, preferably Mg, Ca, Pr, Nd, Tb, and Dy, more preferably Ca, Pr, Nd, and Dy.

The amount (a) of R is 10 to 15 atom %, as recited above, and preferably 12 to 15 atom %. The amount (b) of E is 0.005 to 2 atom %, preferably 0.01 to 2 atom %, and more preferably 0.02 to 1.5 atom %.

The amount (c) of T, which is Fe and/or Co, is preferably at least 60 atom %, and more preferably at least 70 atom %. Although cobalt can be omitted (i.e., 0 atom %), cobalt may be included in an amount of at least 1 atom %, preferably at least 3 atom %, more preferably at least 5 atom % for improving the temperature stability of remanence or other purposes.

Preferably A, which is boron and/or carbon, contains at least 80 atom %, more preferably at least 85 atom % of boron. The amount (d) of A is 3 to 15 atom %, as recited above, preferably 4 to 12 atom %, and more preferably 5 to 8 atom %.

The amount (e) of fluorine is 0.01 to 4 atom %, as recited above, preferably 0.02 to 3.5 atom %, and more preferably 0.05 to 3.5 atom %. At too low a fluorine content, an enhancement of coercive force is not observable. Too high a fluorine content alters the grain boundary phase, leading to a reduced coercive force.

The amount (f) of oxygen is 0.04 to 4 atom %, as recited above, preferably 0.04 to 3.5 atom %, and more preferably 0.04 to 3 atom %.

The amount (g) of other metal element M is 0.01 to 11 atom %, as recited above, preferably 0.01 to 8 atom %, and more preferably 0.02 to 5 atom %. The other metal element M may be present in an amount of at least 0.05 atom %, and especially at least 0.1 atom %.

It is noted that the sintered magnet body has a center and a surface. In the invention, constituent element F is distributed in the sintered magnet body such that its concentration increases on the average from the center of the magnet body toward the surface of the magnet body. Specifically, the concentration of F is highest at the surface of the magnet body and gradually decreases toward the center of the magnet body. Fluorine may be absent at the magnet body center because the invention merely requires that the oxyfluoride of R and E, typically $(R_{1-x}E_x)OF$ (wherein x is a number of 0 to 1) be present at grain boundaries in a grain boundary region that extends from the magnet body surface to a depth of at least 20 μm. While grain boundaries surround primary phase grains of $(R,E)_2T_{14}A$ tetragonal system within the sintered magnet body, the concentration of E/(R+E) contained in the grain boundaries is on the average higher than the concentration of E/(R+E) contained in the primary phase grains.

In the permanent magnet of the invention, the oxyfluoride of (R,E) is present at grain boundaries in a grain boundary region that extends from the magnet body surface to a depth of at least 20 μm. In a preferred embodiment, particles of the oxyfluoride having an equivalent circle diameter of at least 1 μm is distributed in the grain boundary region at a population of at least 2,000 particles/$mm^2$, more preferably at least 3,000 particles/$mm^2$, most preferably 4,000 to 20,000 particles/$mm^2$. The oxyfluoride is present in an area fraction of at least 1%, more preferably at least 2%, most preferably 2.5 to 10%. The number and area fraction of particles are determined by taking a compositional distribution image by electron probe microanalysis (EPMA), processing the image, and counting oxyfluoride particles having an equivalent circle diameter of at least 1 μm.

The rare earth permanent magnet of the invention can be manufactured by feeding a powder containing E and F to the surface of an R—Fe—B sintered magnet body, and heat treating the packed magnet body. The R—Fe—B sintered magnet body, in turn, can be manufactured by a conventional process including crushing a mother alloy, milling, compacting and sintering.

The mother alloy used herein contains R, T, A, and M. R is at least one element selected from rare earth elements inclusive of Sc and Y. R is typically selected from among Sc, Y, La, Ce, Pr, Nd, Sm, Eu, Gd, Tb, Dy, Ho, Er, Yb, and Lu. Desirably, R contains Nd, Pr and Dy as main components. These rare earth elements inclusive of Sc and Y are preferably present in an amount of 10 to 15 atom %, more preferably 12 to 15 atom % of the overall alloy. More desirably, R contains one or both of Nd and Pr in an amount of at least 10 atom %, especially at least 50 atom % of the entire R. T is one or both of Fe and Co, and Fe is preferably contained in an amount of at least 50 atom %, and more preferably at least 65 atom % of the overall alloy. A is one or both of boron and carbon, and boron is preferably contained in an amount of 2 to 15 atom %, and more preferably 3 to 8 atom % of the overall alloy. M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W. M may be contained in an amount of 0.01 to 11 atom %, and preferably 0.1 to 5 atom % of the overall alloy. The balance is composed of incidental impurities such as N and O.

The mother alloy is prepared by melting metal or alloy feeds in vacuum or an inert gas atmosphere, typically argon atmosphere, and casting the melt into a flat mold or book mold or strip casting. A possible alternative is a so-called two-alloy process involving separately preparing an alloy approximate to the $R_2Fe_{14}B$ compound composition constituting the primary phase of the relevant alloy and an R-rich alloy serving as a liquid phase aid at the sintering temperature, crushing, then weighing and mixing them. Notably, the alloy approximate to the primary phase composition is subjected to homogenizing treatment, if necessary, for the purpose of increasing the amount of the $R_2Fe_{14}B$ compound phase, since α-Fe is likely to be left depending on the cooling rate during casting and the alloy composition. The homogenizing treatment is a heat treatment at 700 to 1,200° C. for at least one hour in vacuum or in an Ar atmosphere. To the R-rich alloy serving as a liquid phase aid, a so-called melt quenching or strip casting technique is applicable as well as the above-described casting technique.

The mother alloy is generally crushed to a size of 0.05 to 3 mm, preferably 0.05 to 1.5 mm. The crushing step uses a Brown mill or hydriding pulverization, with the hydriding pulverization being preferred for those alloys as strip cast. The coarse powder is then finely divided to a size of generally 0.2 to 30 μm, preferably 0.5 to 20 μm, for example, by a jet mill using nitrogen under pressure. The oxygen content of the sintered body can be controlled by admixing a minor amount of oxygen with the pressurized nitrogen at this point. The oxygen content of the final sintered body, which is given as the oxygen introduced during the preparation of the ingot plus the oxygen taken up during transition from the fine powder to the sintered body, is preferably 0.04 to 4 atom %, more preferably 0.04 to 3.5 atom %.

The fine powder is then compacted under a magnetic field on a compression molding machine and placed in a sintering furnace. Sintering is effected in vacuum or in an inert gas atmosphere usually at a temperature of 900 to 1,250° C., preferably 1,000 to 1,100° C. The thus sintered magnet contains 60 to 99 vol %, preferably 80 to 98 vol % of the tetragonal $R_2Fe_{14}B$ compound as a primary phase, the balance being 0.5 to 20 vol % of an R-rich phase, 0 to 10 vol % of a B-rich phase, 0.1 to 10 vol % of R oxide, and at least one of carbides, nitrides and hydroxides of incidental impurities or a mixture or composite thereof.

The sintered block is machined into a magnet body of a predetermined shape, after which E and fluorine atoms are absorbed and infiltrated in the magnet body in order to impart the characteristic physical structure that the electric resistance of a surface layer is higher than in the interior.

Referring to a typical treatment, a powder containing E and fluorine atoms is disposed on the surface of the sintered magnet body. The magnet body packed with the powder is heat treated in vacuum or in an atmosphere of inert gas such as Ar or He at a temperature of not higher than the sintering temperature (referred to as Ts), preferably 200° C. to (Ts-5)° C., especially 250° C. to (Ts-10)° C. for about 0.5 to 100 hours, preferably about 1 to 50 hours. Through the heat treatment, E and fluorine are infiltrated into the magnet from the surface and the R oxide within the sintered magnet body reacts with fluorine to make a chemical change into an oxyfluoride.

The oxyfluoride of R within the magnet is typically ROF, although it generally denotes oxyfluorides containing R, oxygen and fluorine that can achieve the effect of the invention including $RO_mF_n$ (wherein m and n are positive numbers) and modified or stabilized forms of $RO_mF_n$ wherein part of R is replaced by a metal element.

The amount of fluorine absorbed in the magnet body at this point varies with the composition and particle size of the powder used, the proportion of the powder occupying the magnet surface-surrounding space during the heat treatment, the specific surface area of the magnet, the temperature and time of the heat treatment although the absorbed fluorine amount is preferably 0.01 to 4 atom %. The absorbed fluorine amount is further preferably 0.02 to 3.5 atom %, especially 0.05 to 3.5 atom % in order that particles of the oxyfluoride having an equivalent circle diameter of at least 1 μm be distributed along the grain boundaries at a population of at least 2,000 particles/mm$^2$, more preferably at least 3,000 particles/mm$^2$. For absorption, fluorine is fed to the surface of the magnet body in an amount of preferably 0.03 to 30 mg/cm$^2$, more preferably 0.15 to 15 mg/cm$^2$ of the surface.

As described above, in a region that extends from the magnet body surface to a depth of at least 20 μm, particles of the oxyfluoride having an equivalent circle diameter of at least 1 μm are distributed at grain boundaries at a population of at least 2,000 particles/mm$^2$. The depth from the magnet body surface of the region where the oxyfluoride is present can be controlled by the concentration of oxygen in the magnet body. In this regard, it is recommended that the concentration of oxygen contained in the magnet body be 0.04 to 4 atom %, more preferably 0.04 to 3.5 atom %, most preferably 0.04 to 3 atom %. If the depth from the magnet body surface of the region where the oxyfluoride is present, the particle diameter of the oxyfluoride, and the population of the oxyfluoride are outside the above-specified ranges, undesirably the electric resistivity of the magnet body surface layer could not be effectively increased.

Through the heat treatment, the E component is also enriched adjacent to grain boundaries. The total amount of E component absorbed in the magnet body is preferably 0.005 to 2 atom %, more preferably 0.01 to 2 atom %, even more preferably 0.02 to 1.5 atom %. For absorption, the E component is fed to the surface of the magnet body in a total amount of preferably 0.07 to 70 mg/cm$^2$, more preferably 0.35 to 35 mg/cm$^2$ of the surface.

The surface layer or region of the magnet body where the oxyfluoride is present in the above-described range has an electric resistivity of preferably at least $5.0\times10^{-6}$ Ωm, more preferably at least $1.0\times10^{-5}$ Ωm. A central region of the magnet body has a resistivity of the order of $2\times10^{-6}$ Ωm. Preferably the resistivity of the surface region is higher than that of the central region by a factor of at least 2.5, especially at least 5. A resistivity outside the range fails to reduce the eddy current effectively or to prevent the magnet body from generating heat.

In the permanent magnet of the invention, the eddy current loss in the surface region is reduced to about one half or less as compared with prior art magnets.

The permanent magnet material containing R oxyfluoride of the invention has a graded function that resistivity varies from the surface toward the interior and can be used as a high-performance rare earth permanent magnet featuring the restrained generation of eddy current in a magnetic circuit, especially as a magnet for IPM motors.

EXAMPLE

Examples of the present invention are given below by way of illustration and not by way of limitation.

Example 1 and Comparative Example 1

An alloy in thin plate form was prepared by using Nd, Co, Al, and Fe metals of at least 99 wt % purity and ferroboron, weighing predetermined amounts of them, high-frequency melting them in an Ar atmosphere, and casting the melt onto a single chill roll of copper (strip casting technique). The alloy consisted of 12.8 atom % Nd, 1.0 atom % Co, 0.5 atom % Al, 5.8 atom % B, and the balance of Fe. It is designated alloy A. The alloy A was ground to a size of under 30 mesh by the hydriding technique including the steps of hydriding the alloy, and heating up to 500° C. for partial dehydriding while evacuating the chamber to vacuum.

Separately, an alloy was prepared by using Nd, Dy, Fe, Co, Al, and Cu metals of at least 99 wt % purity and ferroboron, weighing predetermined amounts of them, high-frequency melting them in an Ar atmosphere, and casting the melt in a mold. The alloy consisted of 20 atom % Nd, 10 atom % Dy, 24 atom % Fe, 6 atom % B, 1 atom % Al, 2 atom % Cu, and the balance of Co. It is designated alloy B. The alloy B was crushed to a size of under 30 mesh in a nitrogen atmosphere on a Brown mill.

Subsequently, the powders of alloys A and B were weighed in an amount of 93 wt % and 7 wt % and mixed for 30 minutes on a nitrogen-blanketed V blender. On a jet mill using nitrogen gas under pressure, the powder mixture was finely divided into a powder with a mass base median diameter of 4 μm. The fine powder was oriented in a magnetic field of 15 kOe under a nitrogen atmosphere and compacted under a pressure of about 1 ton/cm$^2$. The compact was then placed in a sintering furnace with an Ar atmosphere where it was sintered at 1,060° C. for 2 hours, obtaining a magnet block. The foregoing steps were performed in a low oxygen atmosphere so that the resulting magnet block had an oxygen concentration of 0.81 atom %. Using a diamond cutter, the magnet block was machined on all the surfaces to dimensions of 50 mm×50 mm×5 mm. The magnet body was successively washed with alkaline solution, deionized water, aqueous acid and deionized water, and dried.

Next, neodymium fluoride powder having an average particle size of 10 μm was mixed with ethanol in a weight fraction of 50% to form a slurry. The magnet body was immersed in the slurry for 1 minute while sonicating the slurry, taken up and immediately dried with hot air. The amount of neodymium fluoride fed was 0.8 mg/cm$^2$. Thereafter, the packed magnet body was subjected to absorptive treatment in an Ar atmosphere at 800° C. for 10 hours and then aging treatment at 500° C. for 1 hour and quenched, obtaining a magnet body within the scope of the invention. This magnet body is designated M1. For comparison purposes, a magnet body was similarly prepared by effecting heat treatment without the neodymium fluoride package. This is designated P1.

The magnet bodies M1 and P1 were measured for magnetic properties (remanence Br, coercive force Hcj), with the results shown in Table 1. The compositions of the magnets are shown in Table 2. The magnet M1 of the invention exhibited substantially equal magnetic properties as compared with the magnet body P1 having undergone heat treatment without the neodymium fluoride package.

Subsequently, the magnet bodies M1 and P1 were magnetized, sealed with a heat insulating material, and mounted in a solenoid coil. While the coil was actuated at 1,000 kHz to generate an alternating magnetic field of 12 kA/m, the temperature of the magnet body was monitored to determine a change of temperature with time, from which an eddy current loss was computed. The results are also shown in Table 1. The eddy current loss of the inventive magnet body M1 is less than one half of the loss of the comparative magnet body P1.

The surface layer of magnet body M1 was analyzed by electron probe microanalysis (EPMA), with its compositional distribution images of Nd, O and F being shown in FIGS. 1*a*, 1*b* and 1*c*. A number of NdOF particles were distributed in the surface layer. In this region, those NdOF particles having an equivalent circle diameter of at least 1 μm had a population of 4,500 particles/mm$^2$ and an area fraction of 3.8%.

Figure 2:
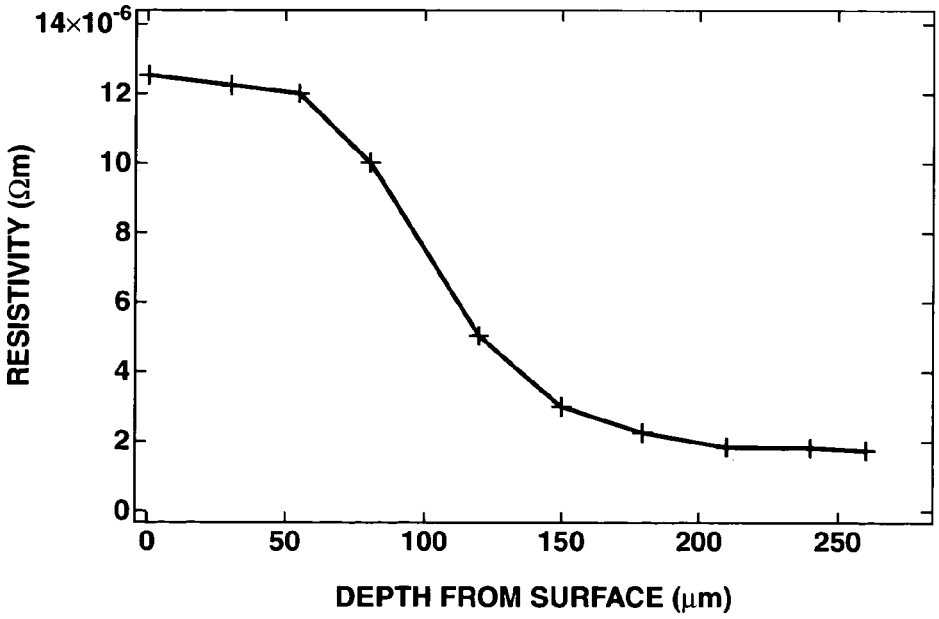
FIG. 2 is a graph in which the resistivity of the magnet body M1 of Example 1 is plotted relative to a depth from the magnet surface.

The magnet bodies M1 and P1 were machined into a rod of 1 mm×1 mm×10 mm. At this time, five of the magnet surfaces were machined so that one magnet surface was left intact after the machining. The non-machined surface (1×10 mm) of rod M1 was wet polished with #180 abrasive paper and mirror polished with #1000 to #4000 abrasive papers while resistivity was measured on that surface. FIG. 2 is a graph showing the resistivity versus the thickness of a surface layer abraded by polishing. At a depth of at least 200 μm from the magnet body surface, the resistivity becomes as low as in prior art magnets. It is demonstrated that the magnet body M1 has a higher resistivity at a position nearer to the surface layer, which leads to a reduced eddy current loss. The data prove that by dispersing oxyfluoride only in a surface layer, a permanent magnet having a reduced eddy current loss is obtainable.

Example 2 and Comparative Example 2

An alloy in thin plate form was prepared by using Nd, Co, Al, and Fe metals of at least 99 wt % purity and ferroboron, weighing predetermined amounts of them, high-frequency melting them in an Ar atmosphere, and casting the melt onto a single chill roll of copper (strip casting technique). The alloy consisted of 12.8 atom % Nd, 1.0 atom % Co, 0.5 atom % Al, 5.8 atom % B, and the balance of Fe. It is designated alloy A. The alloy A was ground to a size of under 30 mesh by the hydriding technique including the steps of hydriding the alloy, and heating up to 500° C. for partial dehydriding while evacuating the chamber to vacuum.

Separately, an alloy was prepared by using Nd, Dy, Fe, Co, Al, and Cu metals of at least 99 wt % purity and ferroboron, weighing predetermined amounts of them, high-frequency melting them in an Ar atmosphere, and casting the melt in a mold. The alloy consisted of 20 atom % Nd, 10 atom % Dy, 24 atom % Fe, 6 atom % B, 1 atom % Al, 2 atom % Cu, and the balance of Co. It is designated alloy B. The alloy B was crushed to a size of under 30 mesh in a nitrogen atmosphere on a Brown mill.

Subsequently, the powders of alloys A and B were weighed on an amount of 93 wt % and 7 wt % and mixed for 30 minutes in a nitrogen-blanketed V blender. On a jet mill using nitrogen gas under pressure, the powder mixture was finely divided into a powder with a mass base median diameter of 4 μm. The fine powder was oriented in a magnetic field of 15 kOe under a nitrogen atmosphere and compacted under a pressure of about 1 ton/cm$^2$. The compact was then placed in a sintering furnace with an Ar atmosphere where it was sintered at 1,060° C. for 2 hours, obtaining a magnet block. The foregoing steps were performed in a low oxygen atmosphere so that the resulting magnet block had an oxygen concentration of 0.73 atom %. Using a diamond cutter, the magnet-block was machined on all the surfaces to dimensions of 50 mm×50 mm×5 mm. The magnet body was successively washed with alkaline solution, deionized water, aqueous acid and deionized water, and dried.

Next, dysprosium fluoride powder having an average particle size of 5 μm was mixed with ethanol in a weight fraction of 50% to form a slurry. The magnet body was immersed in the slurry for 1 minute while sonicating the slurry, taken up and immediately dried with hot air. The amount of dysprosium fluoride fed was 1.1 mg/cm$^2$. Thereafter, the packed magnet body was subjected to absorptive treatment in an Ar atmosphere at 900° C. for 1 hour and then aging treatment at 500° C. for 1 hour and quenched, obtaining a magnet body within the scope of the invention. This magnet body is designated M2. For comparison purposes, a magnet body was similarly prepared by effecting heat treatment without the dysprosium fluoride package. This is designated P2.

The magnet bodies M2 and P2 were measured for magnetic properties (Br, Hcj), with the results shown in Table 1. The compositions of the magnets are shown in Table 2. The magnet M2 of the invention exhibited a substantially equal remanence and a higher coercive force as compared with the magnet body P2 having undergone heat treatment without the dysprosium fluoride package. Subsequently, the eddy current loss was measured by the same procedure as in Example 1, with the results also shown in Table 1. The eddy current loss (2.41 W) of the inventive magnet body M2 is less than one half of the loss (6.86 W) of the comparative magnet body P2. The surface layer of magnet body M2 was analyzed by EPMA to determine the concentration distributions of elements, indicating the presence of numerous ROF particles in the same form as in Example 1.

Example 3 and Comparative Example 3

An alloy in thin plate form was prepared by using Nd, Co, Al, and Fe metals of at least 99 wt % purity and ferroboron, weighing predetermined amounts of them, high-frequency melting them in an Ar atmosphere, and casting the melt onto a single chill roll of copper (strip casting technique). The alloy consisted of 13.5 atom % Nd, 1.0 atom % Co, 0.5 atom % Al, 5.8 atom % B, and the balance of Fe. The alloy was ground to a size of under 30 mesh by the hydriding technique including the steps of hydriding the alloy, and heating up to 500° C. for partial dehydriding while evacuating the chamber to vacuum.

On a jet mill using nitrogen gas under pressure, the coarse powder was finely divided into a powder with a mass base median diameter of 4 μm. The fine powder was oriented in a magnetic field of 15 kOe under a nitrogen atmosphere and compacted under a pressure of about 1 ton/cm$^2$. The compact was then placed in a sintering furnace with an Ar atmosphere where it was sintered at 1,060° C. for 2 hours, obtaining a magnet block. The foregoing steps were performed in a low oxygen atmosphere so that the resulting magnet block had an oxygen concentration of 0.89 atom %. Using a diamond cutter, the magnet block was machined on all the surfaces to dimensions of 50 mm×50 mm×5 mm.

Next, praseodymium fluoride powder having an average particle size of 5 μm was mixed with ethanol in a weight fraction of 50% to form a slurry. The magnet body was immersed in the slurry for 1 minute while sonicating the slurry, taken up and immediately dried with hot air. The amount of praseodymium fluoride fed was 0.9 mg/cm$^2$. Thereafter, the packed magnet body was subjected to absorptive treatment in an Ar atmosphere at 900° C. for 5 hours and then aging treatment at 500° C. for 1 hour and quenched, obtaining a magnet body within the scope of the invention. This magnet body is designated M3. For comparison purposes, a magnet body was similarly prepared by effecting heat treatment without the praseodymium fluoride package. This is designated P3.

The magnet bodies M3 and P3 were measured for magnetic properties (Br, Hcj), with the results shown in Table 1. The compositions of the magnets are shown in Table 2. The magnet M3 of the invention exhibited a substantially equal remanence and a higher coercive force as compared with the magnet body P3 having undergone heat treatment without the praseodymium fluoride package. Subsequently, the eddy current loss was measured by the same procedure as in Example 1, with the results also shown in Table 1. The eddy current loss of the inventive magnet body M3 is less than one half of the loss of the comparative magnet body P3. The surface layer of magnet body M3 was analyzed by EPMA to determine the concentration distributions of elements, indicating the presence of numerous ROF particles in the same form as in Example 1.

Example 4 and Comparative Example 4

An alloy in thin plate form was prepared by using Nd, Co, Al, and Fe metals of at least 99 wt % purity and ferroboron, weighing predetermined amounts of them, high-frequency melting them in an Ar atmosphere, and casting the melt onto a single chill roll of copper (strip casting technique). The alloy consisted of 12.8 atom % Nd, 1.0 atom % Co, 0.5 atom % Al, 5.8 atom % B, and the balance of Fe. It is designated alloy A. The alloy A was ground to a size of under 30 mesh by the hydriding technique including the steps of hydriding the alloy, and heating up to 500° C. for partial dehydriding while evacuating the chamber to vacuum.

Separately, an alloy was prepared by using Nd, Dy, Fe, Co, Al, and Cu metals of at least 99 wt % purity and ferroboron, weighing predetermined amounts of them, high-frequency melting them in an Ar atmosphere, and casting the melt in a mold. The alloy consisted of 20 atom % Nd, 10 atom % Dy, 24 atom % Fe, 6 atom % B, 1 atom % Al, 2 atom % Cu, and the balance of Co. It is designated alloy B. The alloy B was crushed to a size of under 30 mesh in a nitrogen atmosphere on a Brown mill.

Subsequently, the powders of alloys A and B were weighed in an amount of 88 wt % and 12 wt % and mixed for 30 minutes on a nitrogen-blanketed V blender. On a jet mill using nitrogen gas under pressure, the powder mixture was finely divided into a powder with a mass base median diameter of 5.5 μm. The fine powder was oriented in a magnetic field of 15 kOe under a nitrogen atmosphere and compacted under a pressure of about 1 ton/cm$^2$. The compact was then placed in a sintering furnace with an Ar atmosphere where it was sintered at 1,060° C. for 2 hours, obtaining a magnet block. The foregoing steps were performed in an atmosphere having an oxygen concentration of 21% so that the resulting magnet block had an oxygen concentration of 2.4 atom %. Using a diamond cutter, the magnet block was machined on all the surfaces to dimensions of 50 mm×50 mm×5 mm. The magnet body was successively washed with alkaline solution, deionized water, aqueous acid and deionized water, and dried.

Next, dysprosium fluoride powder having an average particle size of 5 μm was mixed with ethanol in a weight fraction of 50% to form a slurry. The magnet body was immersed in the slurry for 1 minute while sonicating the slurry, taken up and immediately dried with hot air. The amount of dysprosium fluoride fed was 1.4 mg/cm$^2$. Thereafter, the packed magnet body was subjected to absorptive treatment in an Ar atmosphere at 900° C. for 1 hour and then aging treatment at 500° C. for 1 hour and quenched, obtaining a magnet body within the scope of the invention. This magnet body is designated M4. For comparison purposes, a magnet body was similarly prepared by effecting heat treatment without the dysprosium fluoride package. This is designated P4.

The magnet bodies M4 and P4 were measured for magnetic properties (Br, Hcj), with the results shown in Table 1. The compositions of the magnets are shown in Table 2. The magnet M4 of the invention exhibited a substantially equal remanence and a higher coercive force as compared with the magnet body P4 having undergone heat treatment without the dysprosium fluoride package. Subsequently, the eddy current loss was measured by the same procedure as in Example 1, with the results also shown in Table 1. The eddy current loss (2.25 W) of the inventive magnet body M4 is less than one half of the loss (5.53 W) of the comparative magnet body P4.

Figure 3:
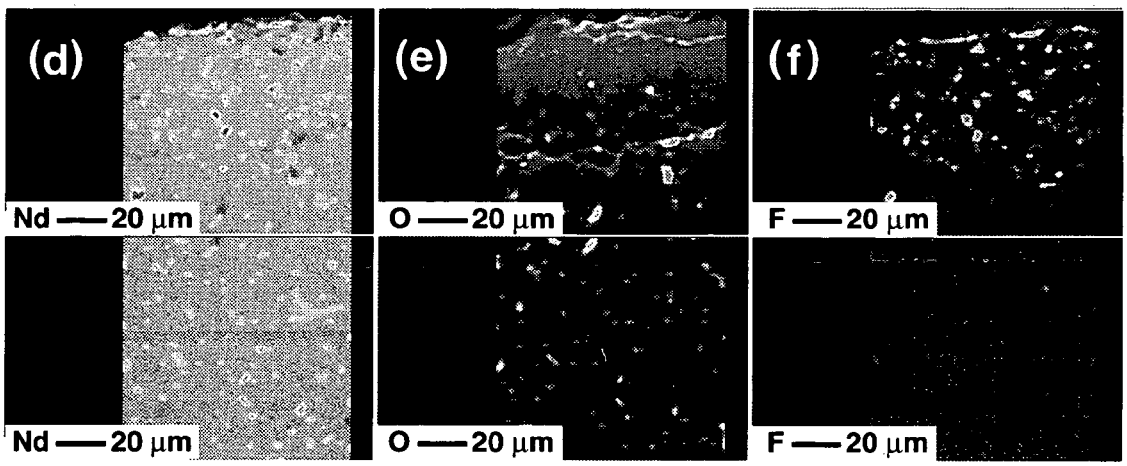
FIGS. 3*d*, 3*e*, and 3*f* are photomicrographs showing compositional distribution images of Nd, O, and F in a magnet body M4 manufactured in Example 4, respectively.
Figure 4:
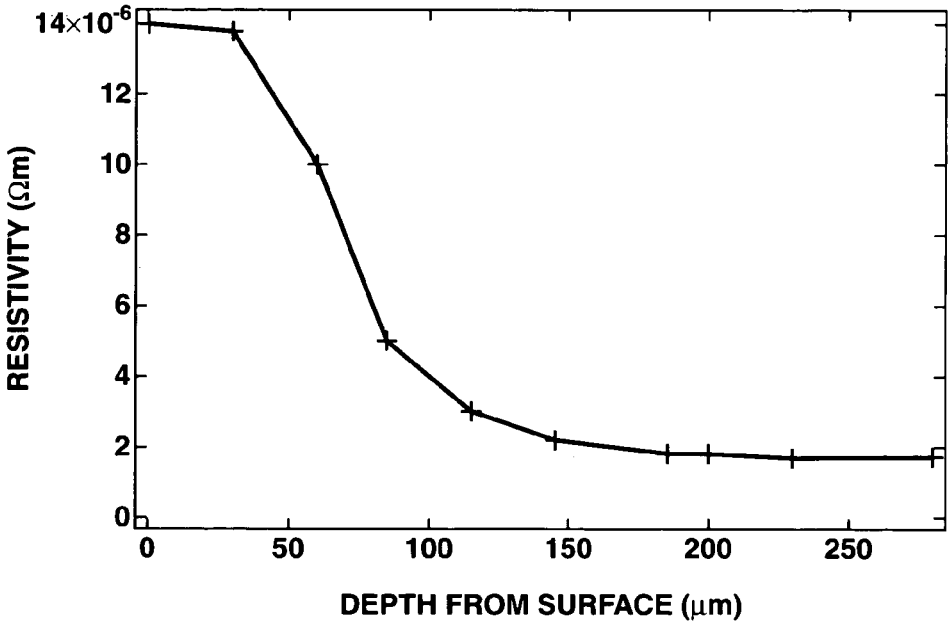
FIG. 4 is a graph in which the resistivity of the magnet body M4 of Example 4 is plotted relative to a depth from the magnet surface.

The surface layer of magnet body M4 was analyzed by EPMA, with its compositional distribution images of Nd, O and F being shown in FIGS. 3*d*, 3*e* and 3*f*. A number of NdOF particles were distributed in the surface layer. In this region, they had a population of 3,200 particles/mm$^2$ and an area fraction of 8.5%. The resistivity of magnet body M4 was measured as in Example 1. FIG. 4 is a graph showing the resistivity versus the thickness of a surface layer abraded by polishing. At a depth of at least 170 μm from the magnet body surface, the resistivity becomes as low as in prior art magnets.

Example 5 and Comparative Example 5

An alloy in thin plate form was prepared by using Nd, Co, Al, and Fe metals of at least 99 wt % purity and ferroboron, weighing predetermined amounts of them, high-frequency melting them in an Ar atmosphere, and casting the melt onto a single chill roll of copper (strip casting technique). The alloy consisted of 12.8 atom % Nd, 1.0 atom % Co, 0.5 atom % Al, 5.8 atom % B, and the balance of Fe. It is designated alloy A. The alloy A was ground to a size of under 30 mesh by the hydriding technique including the steps of hydriding the alloy, and heating up to 500° C. for partial dehydriding while evacuating the chamber to vacuum.

Separately, an alloy was prepared by using Nd, Dy, Fe, Co, Al, and Cu metals of at least 99 wt % purity and ferroboron, weighing predetermined amounts of them, high-frequency melting them in an Ar atmosphere, and casting the melt in a mold. The alloy consisted of 20 atom % Nd, 10 atom % Dy, 24 atom % Fe, 6 atom % B, 1 atom % Al, 2 atom % Cu, and the balance of Co. It is designated alloy B. The alloy B was crushed to a size of under 30 mesh in a nitrogen atmosphere on a Brown mill.

Subsequently, the powders of alloys A and B were weighed in an amount of 93 wt % and 7 wt % and mixed for 30 minutes on a nitrogen-blanketed V blender. On a jet mill using nitrogen gas under pressure, the powder mixture was finely divided into a powder with a mass base median diameter of 4 μm. The fine powder was oriented in a magnetic field of 15 kOe under a nitrogen atmosphere and compacted under a pressure of about 1 ton/cm$^2$. The compact was then placed in a sintering furnace with an Ar atmosphere where it was sintered at 1,060° C. for 2 hours, obtaining a magnet block. The foregoing steps were performed in a low oxygen atmosphere so that the resulting magnet block had an oxygen concentration of 0.73 atom %. Using a diamond cutter, the magnet block was machined on all the surfaces to dimensions of 50 mm×50 mm×5 mm. The magnet body was successively washed with alkaline solution, deionized water, aqueous acid and deionized water, and dried.

Next, calcium fluoride powder having an average particle size of 10 μm was mixed with ethanol in a weight fraction of 50% to form a slurry. The magnet body was immersed in the slurry for 1 minute while sonicating the slurry, taken up and immediately dried with hot air. The amount of calcium fluoride fed was 0.7 mg/cm$^2$. Thereafter, the packed magnet body was subjected to absorptive treatment in an Ar atmosphere at 900° C. for 1 hour and then aging treatment at 500° C. for 1 hour and quenched, obtaining a magnet body within the scope of the invention. This magnet body is designated M5. For comparison purposes, a magnet body was similarly prepared by effecting heat treatment without the calcium fluoride package. This is designated P5.

The magnet bodies M5 and P5 were measured for magnetic properties (Br, Hcj), with the results shown in Table 1. The compositions of the magnets are shown in Table 2. The magnet M5 of the invention exhibited a substantially equal remanence and coercive force as compared with the magnet body P5 having undergone heat treatment without the calcium fluoride package. Subsequently, the eddy current loss was measured by the same procedure as in Example 1, with the results also shown in Table 1. The eddy current loss (2.44 W) of the inventive magnet body M5 is less than one half of the loss (6.95 W) of the comparative magnet body P5. The surface layer of magnet body M5 was analyzed by EPMA to determine the concentration distributions of elements, indicating the presence of numerous ROF particles in the same form as in Example 1.

TABLE 1

| | | Br (T) | Hcj (kA/m) | Eddy current loss (W) |
|---|---|---|---|---|
| Example 1 | M1 | 1.435 | 960 | 2.53 |
| Example 2 | M2 | 1.425 | 1480 | 2.41 |
| Example 3 | M3 | 1.425 | 1120 | 2.64 |
| Example 4 | M4 | 1.338 | 1340 | 2.25 |
| Example 5 | M5 | 1.398 | 960 | 2.44 |
| Comparative Example 1 | P1 | 1.440 | 960 | 6.75 |
| Comparative Example 2 | P2 | 1.420 | 1080 | 6.86 |
| Comparative Example 3 | P3 | 1.420 | 1080 | 6.91 |
| Comparative Example 4 | P4 | 1.341 | 1260 | 5.53 |
| Comparative Example 5 | P5 | 1.410 | 1100 | 6.95 |

TABLE 2

| | | R [at. %] | E [at. %] | T [at. %] | A [at. %] | F [at. %] | O [at. %] | M** [at. %] |
|---|---|---|---|---|---|---|---|---|
| Example 1 | M1 | 13.955* | 13.260* | 78.754 | 5.827 | 0.181 | 0.613 | 0.677 |
| Example 2 | M2 | 13.933* | 0.771* | 78.894 | 5.837 | 0.253 | 0.409 | 0.678 |
| Example 3 | M3 | 13.257 | 0.230 | 78.957 | 5.782 | 0.598 | 0.730 | 0.498 |
| Example 4 | M4 | 14.650* | 1.259* | 77.192 | 5.791 | 0.279 | 1.318 | 0.795 |
| Example 5 | M5 | 13.828 | 0.042 | 78.768 | 5.828 | 0.122 | 0.744 | 0.677 |
| Comparative Example 1 | P1 | 13.928* | 13.220* | 78.941 | 5.841 | 0.000 | 0.615 | 0.678 |
| Comparative Example 2 | P2 | 13.895* | 0.688* | 79.154 | 5.857 | 0.000 | 0.415 | 0.680 |
| Comparative Example 3 | P3 | 13.362 | 0.000 | 79.582 | 5.828 | 0.000 | 0.731 | 0.502 |
| Comparative Example 4 | P4 | 14.612* | 1.169* | 77.477 | 5.812 | 0.000 | 1.317 | 0.798 |
| Comparative Example 5 | P5 | 13.849 | 0.000 | 78.890 | 5.837 | 0.000 | 0.751 | 0.678 |

*Total amount of common element contained as R and E in magnet material.
**Total amount of element as M in formula (1) or (2).

Analytical values of rare earth elements and alkaline earth metal elements were determined by entirely dissolving samples (prepared as in Examples and Comparative Examples) in aqua regia, and effecting measurement by inductively coupled plasma (ICP), analytical values of oxygen determined by inert gas fusion/infrared absorption spectroscopy, and analytical values of fluorine determined by steam distillation/Alfusone colorimetry.

Japanese Patent Application No. 2005-084358 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A functionally graded rare earth permanent magnet having a reduced eddy current loss in the form of a sintered magnet body having an alloy composition of formula (1):

$$R_aE_bT_cA_dF_eO_fM_g \quad (1)$$

wherein R is at least one element selected from rare earth elements inclusive of Sc and Y, and E is at least one element selected from alkaline earth metal elements and rare earth elements, R and E do not contain the same element(s), T is one or both of iron and cobalt, A is one or both of boron and carbon, F is fluorine, O is oxygen, and M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, a through g indicative of atom percents of the corresponding elements in the alloy have values in the range: $10 \leqq a \leqq 15$ and $0.005 \leqq b \leqq 2$, $3 \leqq d \leqq 15$, $0.01 \leqq e \leqq 4$, $0.04 \leqq f \leqq 4$, $0.01 \leqq g \leqq 11$, the balance being c, said magnet body having a center and a surface and being obtained by causing E and fluorine atoms to be absorbed in a R—Fe—B sintered magnet body from its surface, wherein said sintered magnet body is obtained by heat treating the magnet body packed with a powder containing E and fluorine atoms to absorb and infiltrate E and fluorine atoms into the magnet body, and wherein constituent element F is distributed such that its concentration increases on the average from the center toward the surface of the magnet body, grain boundaries surround primary phase grains of $(R,E)_2T_{14}A$ tetragonal system within the sintered magnet body, the concentration of E/(R+E) contained in the grain boundaries is on the average higher than the concentration of E/(R+E) contained in the primary phase grains, an oxyfluoride of (R,E) is present at grain boundaries in a grain boundary region that extends from the magnet body surface to a depth of at least 20 μm, particles of said oxyfluoride having an equivalent circle diameter of at least 1 μm are distributed in said grain boundary region at a population of at least 2,000 particles/mm$^2$, said oxyfluoride is present in an area fraction of at least 1%, and said magnet body includes a surface layer having a higher electric resistance than in the magnet body interior.

2. The rare earth permanent magnet of claim 1 wherein R comprises at least 10 atom % of Nd and/or Pr.

3. The rare earth permanent magnet of claim 1 wherein T comprises at least 60 atom % of iron.

4. The rare earth permanent magnet of claim 1 wherein A comprises at least 80 atom % of boron.

5. A functionally graded rare earth permanent magnet having a reduced eddy current loss in the form of a sintered magnet body having an alloy composition of formula (2):

$$(R \bullet E)_{a+b}T_cA_dF_eO_fM_g \quad (2)$$

wherein R is at least one element selected from rare earth elements inclusive of Sc and Y, and R and E contain the same element or elements, T is one or both of iron and cobalt, A is one or both of boron and carbon, F is fluorine, O is oxygen, and M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, a through g indicative of atom percents of the corresponding elements in the alloy have values in the range: $10.005 \leqq a+b \leqq 17$, $3 \leqq d \leqq 15$, $0.01 \leqq e \leqq 4$, $0.04 \leqq f \leqq 4$, $0.01 \leqq g \leqq 11$, the balance being c, said magnet body having a center and a surface and being obtained by causing E and fluorine atoms to be absorbed in a R-Fe-B sintered magnet body from its surface, wherein said sintered magnet body is obtained by heat treating the magnet body packed with a powder containing E and fluorine atoms to absorb and infiltrate E and fluorine atoms into the magnet body, and wherein constituent element F is distributed such that its concentration increases on the average from the center toward the surface of the magnet body, grain boundaries surround primary phase grains of $(R,E)_2T_{14}A$ tetragonal system within the sintered magnet body, the E component is enriched adjacent to the grain boundaries, an oxyfluoride of (R,E) is present at grain boundaries in a grain boundary region that extends from the magnet body surface to a depth of at least 20 μm, particles of said oxyfluoride having an equivalent circle diameter of at least 1 μm are distributed in said grain boundary region at a population of at least 2,000 particles/mm$^2$, said oxyfluoride is present in an area fraction of at least 1%, and said magnet body includes a surface layer having a higher electric resistance than in the magnet body interior.

6. The rare earth permanent magnet of claim 5 wherein R comprises at least 10 atom % of Nd and/or Pr.

7. The rare earth permanent magnet of claim 5 wherein T comprises at least 60 atom % of iron.

8. The rare earth permanent magnet of claim 5 wherein A comprises at least 80 atom % of boron.

* * * * *